US005746784A

United States Patent [19]

Thünker et al.

[11] Patent Number: 5,746,784

[45] Date of Patent: May 5, 1998

[54] USE OF FERROCENE

[75] Inventors: Walter Thünker, Bottrop; Gabriele Lohmann, Lünen; Arnim Marschewski, Gelsenkirchen, all of Germany; Tage Nielsen, Espergaerde; Christian Lützen, Ballerup, both of Denmark

[73] Assignees: Chemische Betriebe Pluto GmbH, Herne, Germany; A/S Dampskibsselskabet Svendborg; Dampskibsselskabet AF 1912 A/S, both of Copenhagen, Denmark

[21] Appl. No.: 837,082

[22] Filed: Apr. 14, 1997

Related U.S. Application Data

[63] Continuation of Ser. No. 525,551, Sep. 19, 1995, abandoned.

[30] Foreign Application Priority Data

Mar. 20, 1993 [DE] Germany ..... 43 09 066.4

[51] Int. Cl.[6] ..... C10L 1/23; F02B 75/12

[52] U.S. Cl. ..... 44/361; 123/1 A; 431/4

[58] Field of Search ..... 123/1 A; 44/358, 44/359, 361; 431/4

[56] References Cited

U.S. PATENT DOCUMENTS

| | | | |
|---|---|---|---|
| 2,769,828 | 11/1956 | Sug . | |
| 2,834,796 | 5/1958 | Barusch et al. . | |
| 2,898,360 | 8/1959 | Hogan et al. . | |
| 3,035,968 | 3/1962 | Degoli . | |
| 3,238,158 | 3/1966 | Conca et al. . | |
| 3,341,311 | 9/1967 | Pedersen . | |
| 3,437,634 | 4/1969 | Neuse . | |
| 4,389,220 | 6/1983 | Kracklauer . | |
| 4,908,045 | 3/1990 | Farrar | 44/358 |
| 4,946,609 | 8/1990 | Pruess et al. . | |
| 4,979,447 | 12/1990 | Farrar | 110/345 |
| 4,998,876 | 3/1991 | Farrar | 44/358 |
| 5,299,746 | 4/1994 | Thuenker et al. | 44/639 |

FOREIGN PATENT DOCUMENTS 1034590 6/1993 Canada .

OTHER PUBLICATIONS

Booser, Ph. D., CRC Handbook of Lubrication (Theory and Practice of Tribology, vol. I, Application and Maintenance, pp. 71–76, 1983.

Weast, Ph. D., CRC Handbook of Chemistry and Physics, 46th Ed; The Chemical Rubber Co., pp. F–3, 1965.

*Primary Examiner*—Margaret Medley

*Attorney, Agent, or Firm*—Antonelli, Terry, Stout, & Kraus, LLP

[57] ABSTRACT

A process for reducing carbonaceous deposits caused by the combustion of heavy fuel oil in high-compression, spontaneous-ignition internal combustion engines involves adding an additive such as ferrocene or ethyl ferrocene to a heavy fuel oil having a density of 0.9 to 1.01 kg/dm$^3$ in an amount of 1 to 100 ppm prior to combustion of the fuel oil and combusting the fuel oil in the high-compression, spontaneous-ignition internal combustion engine. The additive is dissolved in the heavy fuel oil.

4 Claims, 1 Drawing Sheet

USE OF FERROCENE

Figure 1:
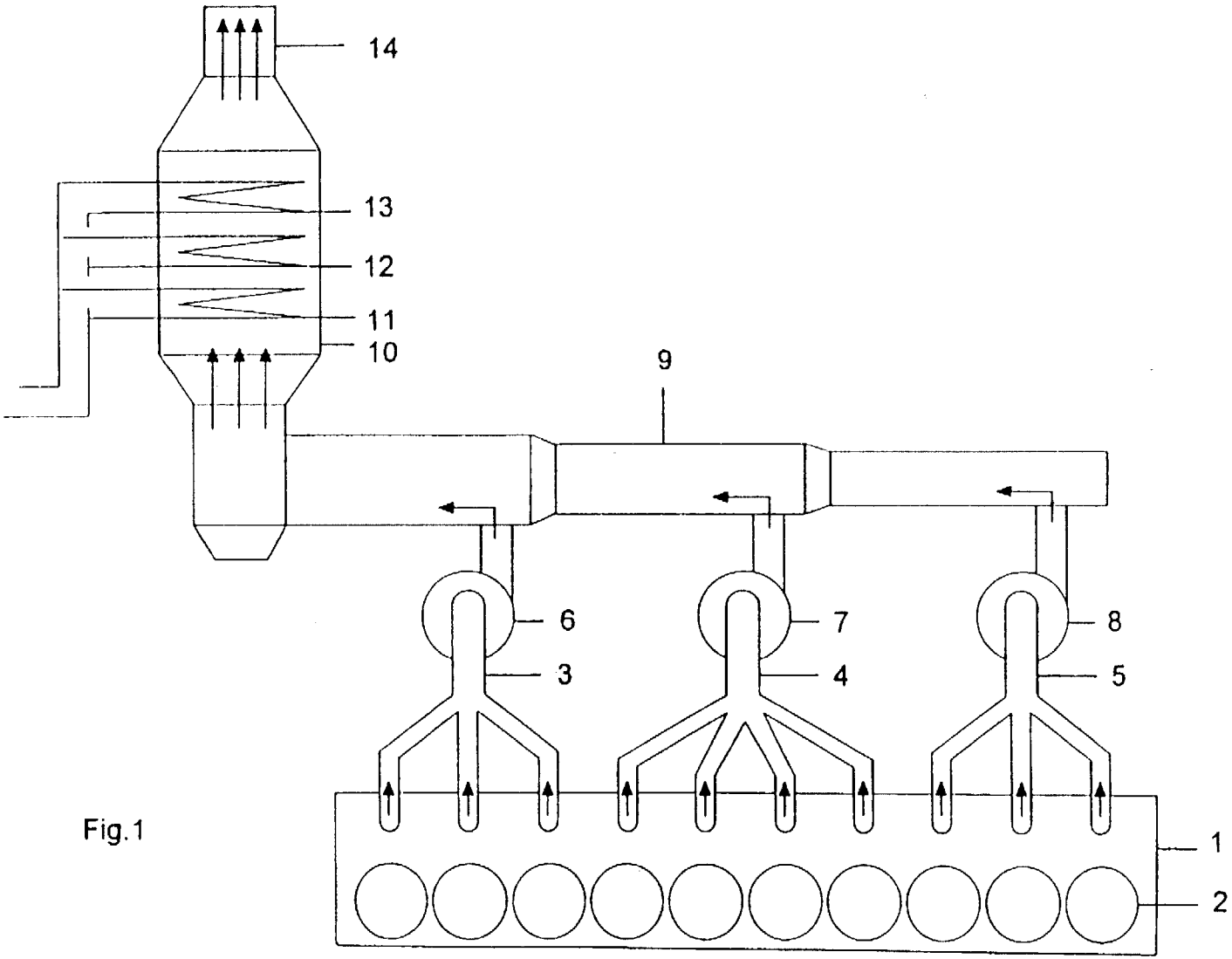

This application is a Continuation application of application Ser. No. 08/525.551, filed Sep. 19, 1995 now abandoned.

The invention relates to the use of ferrocene and/or ferrocene derivatives as an additive to heavy grade internal combustion engine fuels for high-compression spontaneous-ignition engines.

Ferrocene and its derivatives are known from specialist literature. Ferrocene and its production were described for the first time in 'Nature' 168 (1951) page 1039. Subsequently, ferrocene and its derivatives, as well as corresponding production processes, have been the subject-matter of numerous patents, e.g. U.S. Pat. No. 2,650,756, U.S. Pat. No. 2,769,828, U.S. Pat. No. 2,834,796, U.S. Pat. No. 2,898,360, U.S. Pat. No. 3,035,968, U.S. Pat. No. 3,238,158 and U.S. Pat. No. 3,437,634.

It is also known from the patent literature that ferrocene can advantageously affect combustion processes. DE Patent 34 18 648, in addition to many other compounds, also mentioned ferrocene (dicyclopentadienyl iron) as a possible additive for the purpose of optimizing the combustion of fuel oil, i.e. to facilitate the transportation of the fuel oil through the burner and to promote the complete combustion of the fuel oil.

A process to condition a diesel engine is described in U.S. Pat. No. 4,389,220. To this end, 20 to 30 ppm of ferrocene are added to the diesel fuel. It is intended, hereby, to remove carbonaceous deposits in the combustion chamber and to prevent any renewed formation thereof. It was simultaneously found that the fuel consumption per distance travelled was reduced by up to 5% as a result of this measure. The term diesel fuel in the present instance relates to a fuel which is known, according to ASTM, as "No. 2 fuel oil". A fuel of this kind is a middle distillate from the petroleum refinery process and is available at filling stations under the term "Diesel". The four-stroke diesel engines of road vehicles, e.g. passenger cars, buses, commercial vehicles, are usually run on this fuel. Said fuel conforms to DIN 51601 and, in its quality, is similar to the EL fuel oil. It is thus a light to medium grade fuel.

Heavy grade fuels are used for larger lower speed engines such as are used, for example, in ships or current-generating plants. Here, the problem arises that the performance of downstream units is adversely affected by carbonaceous deposits. Such units include, in particular, turbochargers as well as heat exchangers. Deposits on valves, piston rings and in the combustion chamber are, however, also undesirable, since they may lead to a reduction of the engine performance and/or to an increased wear of the parts concerned.

It is the object of the invention to minimize the above-mentioned deposits or to facilitate the removal thereof.

According to the invention, there is provided the use of ferrocene and/or ferrocene derivatives as an additive in heavy grade internal combustion engine fuels for high-compression spontaneous-ignition engines. The invention may be applied, in particular, to fuels having a density of 0.9 to 1.01 kg/dm$^3$.

The use of ferrocene as an additive has surprisingly proved to be particularly advantageous, in particular when operating large engines of this kind using heavy fuels. This holds true, primarily, in respect of relatively large engines, i.e. engines having a total output of 400 to 100,000, preferably 15,000 to 50,000 and, in particular, of more than 30,000 kW.

As a rule, problems associated with the above-mentioned deposits increase with an increasingly heavy fuel. In the case of said fuels, the use of ferrocene as an additive has surprisingly proved to be particularly effective. This was not to be expected, especially since it was known that ferrocene is very effective in improving the combustion of light fuel oil, but that it was less effective in the case of heavy fuel oil.

The use according to the invention is particularly advantageous for grades which are usually designated as marine fuel oil, "Bunker C" grade, marine diesel fuel, or distilled marine diesel fuel. As can readily be seen from the names of the fuel grades, these are chiefly used to run marine engines.

The fuels in question can, for example, be residues from the atmospheric distillation of crude oil, from vacuum distillation or from a catalytic cracking plant. The density of said fuels in particular ranges between 0.9 and 1.0 kg/dm$^3$. Said fuels may be classified more accurately by referring to ISO 82 17.

According to said standardization, a distinction of two classes of fuels is made, so-called distilled marine fuels (marine distillate fuels) and so-called heavy residual fuels. The first-mentioned group are given a DM type designation and the second group an RM type designation. Certain types are listed below by way of example, setting out their most significant properties such as the density, viscosity, sulphur content and the carbon residue.

| | DMB | DMC | RMA 10 | RMG 35 | RMH 45 |
|---|---|---|---|---|---|
| density kg/dm$^3$ | 0.90 | 0.92 | 0.95 | 0.991 | 1.010 |
| max. kinematic viscosity cSt at | | | | | |
| 40° C. | 11.0 | 14.0 | — | — | — |
| 100° C. | — | — | 10 | 35 | 45 |
| max. carbon residue % by mass | 0.25 | 2.5 | 12 | 18 | 22 |
| max. sulphur content % by mass | 2.0 | 2.0 | 3.5 | 5.0 | 5.0 |

All the DM and RM types can be used as fuels within the context of the present invention.

Many ship engines of large ocean-going ships are two-stroke engines. The invention is particularly applicable to such engines. The invention may thus extend to the use of ferrocene and/or ferrocene derivatives as an additive in fuels used to run two-stroke engines. This is particularly the case when said engines are low-speed engines, having a speed of 900 to 50, preferably 200 to 50 revolutions per minute, in particular a maximum speed of 100 revolutions per minute, or less. Good results can, however, also be achieved by the addition according to the invention in engines having a higher speed as well as in four-stroke engines. The invention may thus extend to the use of ferrocene and/or ferrocene derivatives as an additive in fuels used to run four-stroke engines.

Good results were achieved with a ferrocene addition of 1 to 100 ppm. With an addition of less than 1 ppm, the effects are not as distinct, such that it is not possible to speak of a substantial improvement in comparison to a fuel without an additive. In the case of an additive content in excess of 100 ppm, a limit is reached at which any additional additive causes no additional effect worth mentioning. As a rule, a range of from 5 to 50 ppm is preferred. An optimal range is from 10 to 30 ppm. The additive addition may, for example, be effected such that the additive is dissolved in part of the fuel, and this solution is then again recycled, for example, via a metering pump, to the main fuel flow.

It is possible, at least in part, to use ferrocene derivatives instead of ferrocene. Ferrocene derivatives are compounds in which, starting from the ferrocene parent substance, additional substituents are disposed on one or both cyclopentadienyl rings. Examples hereof are ethyl ferrocene, butyl ferrocene, acetyl ferrocene and 2,2-bis-ethyl ferrocenyl propane.

It is an advantage of the invention that the deposits which originate from the heavy grade fuel used, but also originating from the lubricating oil, are reduced effectively.

The performance of downstream units, such as turbochargers and heat exchanger, as well as engine parts, such as valves and piston rings, is adversely affected, partly to a considerable extent, by the deposits. Considerable effort and expense are frequently required in order to remove the deposits. Thus, for example, it is common in large ocean-going ships to blow crushed nut shells or even rice into the flow of exhaust gas, in order to clean the downstream turbocharger. The greater portion of the deposits is removed from the blade wheels, and also from the upstream nozzle ring, by this so-called 'soft-blasting'. The afore-mentioned procedure is usually carried out daily and, if necessary, even twice daily, while maintaining the full engine load. This method of cleaning is, however, usually not adequate. A washing with water is, therefore, additionally carried out about once a month, or more frequently if required. Since such a washing operation is carried out while the engine load is reduced, a delay for the ship is always involved. During the washing operation, water is introduced into the flow of exhaust gas through a nozzle upstream of the nozzle ring and the blade wheels. Said water-washing operation involves a considerable stress for the turbocharger and other parts, as a result of the thermal shock effect. Accordingly, attempts are made to reduce this water-washing operation to a minimum. The usual time required for such a washing operation is about 2 to 3 hours. The guiding factor, in this regard, is simply the clarity of the water after the rinsing steps. In this connection, the washing water is usually clearly noticeably heavily soiled for 1 to 2 hours. As a result of the use, according to the invention, of fuel comprising ferrocene as an additive, both 'soft-blasting' and the water-washing operation are generally rendered superfluous. This protects the units concerned, without any restriction in performance, and saves time and cuts down on labour input.

When the performance of the turbochargers is adversely affected by deposits, a number of problems may occur. The effectiveness of the turbochargers and, ultimately, therefore also of the entire machine, is reduced, such that a higher fuel consumption is brought about. The deposits may bring about a reduction in speed, down to, in extreme cases, a stoppage of one or more of the blade wheels of the turbocharger. In the case of machines with multiple turbochargers, the blade wheels are supplied with exhaust gas from a common exhaust gas receiver which brings together the exhaust gas from a plurality of cylinders. If the gas is distributed non-uniformly, as a result of the varying flow resistance which, in turn, is caused by the deposits, a drop in speed, a fluctuation in the speed, or a considerable difference in speed between the coupled turbochargers, or even a stoppage may occur. The above-mentioned problems, which must be attributed to the deposits, may result in premature material fatigue or, in extreme cases, to material failure. In the case of particularly heavy deposits, this may also occur in smaller machines which are not equipped with multiple turbochargers. Irregular speed, i.e. an inconstant running, can result in very strong vibrations which can cause, in a short period of time, material damage in the bearings and other machine parts.

Although non-uniform deposits on the blade wheels do not necessarily cause a drop in speed or speed differences, in the case of multiple turbochargers, they do, however, cause undesirable vibrations, as a result of the running out of true, and said vibrations may also be the cause of an increased rate of wear.

Without the additive used according to the invention, it can also be noted in the downstream heat exchangers that deposits form on the heat exchanger surfaces, which deposits, depending on the thickness thereof, impede the exchange of heat. These deposits, which contain mainly carbon, must also be removed from time to time, by means of water-washing, optionally with cleaning additives, e.g. a $CuCl_2$ solution. As a result of the use, according to the invention, of fuels comprising ferrocene as an additive, the formation of deposits is greatly reduced. When a water-washing operation does become necessary (e.g. in a dry dock) after a period of time which is considerably longer than in the case of the state of the art, it is noted that the deposits can be removed far more readily after use, according to the invention, of the fuel comprising the additive. This may possible be attributed to an altered composition of the deposits. It was noted that said deposits had a higher ash content, lower thermal values and a lower carbon content, in contrast to deposits when using fuels with an additive. It may be assumed that said deposits are hydrophobic to a lesser degree, since they contain fewer oily or oil-like components.

As a rule, such water-washing operations of the heat exchangers or of the boiler are carried out, at the latest, every two years when the ship is stationed in a dry dock for regulation maintenance and inspection work. Five or six additional washing operations are, however, normally required between two dry dock stopovers. If the present invention is applied, said additional washing operations can be dispensed with.

The invention will now be described by way of non-limiting example with reference to the accompanying FIG. 1 which diagrammatically shows the exhaust gas route of a ship's engine of the described magnitude. The Figure shows the engine bed (1) with a total of 10 cylinders (2). The exhaust gases from, in each case, 3 or 4 cylinders, respectively, are brought together in a so-called exhaust gas 'receiver' (3, 4, 5) and are admitted to the turbochargers (6, 7, 8). The streams of exhaust gas flowing out of the turbochargers are brought together in an exhaust gas pipe (9) and then flow through a so-called exhaust gas 'boiler' (10) in which are arranged heat exchangers (11, 12, 13), by means of which it is possible to produce high-pressure, medium-pressure and low-pressure steam. The exhaust gases leave the system via the funnel (14).

The invention was successfully tested on a container ship, with the following results.

Technical data of the ship:

60.000 gross registered tons

Technical data of the engine:

output: 33.000 kW cubic capacity: 10 cylinders @ 1.6 $m^3$ speed: max. 90 rpm speed of turbocharger: about 10.000 rpm consumption: about 6 t/h at full load After a successful starting phase, the turbochargers of the engine of this ship were thoroughly cleaned by 'soft-blasting' and a water-washing operation. Approximately 3 months later, without any interim cleaning operations having been carried out, a water-washing operation was undertaken. Although said water-washing operation was not necessary from a technical point of view, since the turbochargers worked satisfactorily, it was undertaken so as to provide information on the degree of pollution (deposits). Whereas, according to the state of the art, it was necessary to carry out a 'soft-blasting' operation on a daily basis and, once a month, a water-washing operation, in the course of which the washing water used remained heavily polluted for 1 to 2 hours, in the present case all cleaning operations were dispensed with for nearly 3 months (85 days) and the washing water nonetheless remained clear from the start. This permits the conclusion that practically no deposits formed during the period mentioned. Even sites which cannot be reached with the usual cleaning methods, showed no dirt deposits or clearly reduced dirt deposits.

In the case of the heat exchangers, it was possible, already visually, to note that distinctly fewer deposits had formed. It was far more readily and rapidly possible to remove the deposits which had formed than was possible heretofore when using the water-washing operation.

In addition, no deposits were visually noted on the piston rings and on the valves.

We claim:

1. A process for reducing carbonaceous deposits resulting from the combustion of heavy residual fuel oil in a low-speed, high-compression, spontaneous-ignition internal combustion engine having a speed of 900 to 50 revolutions per minute, which comprises adding at least one additive selected from the group consisting of ferrocene, ethyl ferrocene, butyl ferrocene and 2,2-bis-ethyl ferrocenyl propane to a heavy fuel oil having a density of 0.9 to 1.01 $kg/dm^3$, the heavy fuel oil being a heavy residual fuel oil, in an amount of 1 to 100 ppm prior to combustion of the residual fuel oil and combusting the residual fuel oil containing the at least one additive in the low-speed, high-compression, spontaneous-ignition internal combustion engine having the speed of 900 to 50 revolutions per minute.

2. The process according to claim 1, wherein the fuel oil containing the at least one additive is combusted in the low-speed high-compression, spontaneous-ignition internal combustion engine and exhaust gases resulting from the combustion are passed through processing units arranged downstream of the engine; the formation of carbonaceous deposits being reduced in the downstream processing units.

3. The process according to claim 1, wherein the residual fuel oil containing the at least one additive is combusted in engines having a total output of 400 to 100,000 kW.

4. The process according to claim 1, wherein the content of the at least one additive in the fuel oil is 5 to 50 ppm.

* * * * *